United States Patent [19]

Waymouth et al.

[11] 4,201,540

[45] May 6, 1980

[54] PERCUSSIVELY IGNITED PHOTOFLASH LAMP AND METHOD OF MAKING SAME

[75] Inventors: John F. Waymouth, Marblehead; Andre C. Bouchard, Peabody; Richard A. Fowler, Ipswich; Harold H. Hall, Jr., Marblehead, all of Mass.

[73] Assignee: GTE Sylvania Incorporated, Stamford, Conn.

[21] Appl. No.: 893,223

[22] Filed: Apr. 4, 1978

[51] Int. Cl.[2] ..... F21K 5/02

[52] U.S. Cl. ..... 431/361

[58] Field of Search ..... 431/361

[56] References Cited

U.S. PATENT DOCUMENTS

| | | | |
|---|---|---|---|
| 2,024,225 | 12/1935 | Igari | 431/361 |
| 3,600,120 | 8/1971 | Kopelman | 431/361 |
| 3,606,607 | 9/1971 | Shaffer et al. | 431/361 |
| 3,700,377 | 10/1972 | Brown | 431/361 |
| 3,706,521 | 12/1972 | Kopelman et al. | 431/361 |
| 3,730,669 | 5/1973 | Shaffer | 431/361 |
| 3,771,941 | 11/1973 | Audesse et al. | 431/361 |
| 3,918,883 | 11/1975 | Armstrong et al. | 431/361 |

FOREIGN PATENT DOCUMENTS 2161365 12/1971 Fed. Rep. of Germany .

*Primary Examiner*—Carroll B. Dority, Jr.
*Attorney, Agent, or Firm*—Lawrence R. Fraley

[57] ABSTRACT

A percussively-ignited photoflash lamp having an hermetically-sealed glass envelope containing no glass-to-metal seals therein. Ignition of the lamp is achieved by applying a percussive force (e.g. striking) to an external surface of the envelope which results in actuation of an ignition means disposed within the envelope. The ignition means, preferably a frictionally disposed, spring-loaded wire having a quantity of pressure sensitive primer thereon, ignites a quantity of shredded combustible material (e.g. zirconium) within the envelope to produce the desired flash. A method of making the lamp is also described.

12 Claims, 8 Drawing Figures

PERCUSSIVELY IGNITED PHOTOFLASH LAMP AND METHOD OF MAKING SAME

BACKGROUND OF THE INVENTION

This invention relates to photoflash lamps and particularly to photoflash lamps which are percussively ignited.

The invention also relates to methods of making lamps of the above variety.

Percussively-ignited photoflash lamps are well known in the art with examples being described in the following U.S. Pat. Nos., all of which are assigned to the assignee of the present invention:

1. 3,600,120 (B. Kopelman)
2. 3,700,377 (S. V. Brown)
3. 3,730,669 (J. W. Shaffer)
4. 3,771,841 (E. G. Audesse et al)
5. 3,918,883 (D. E. Armstrong et al)

As shown therein, such lamps typically include an envelope of light-transmitting material (e.g. glass) with a metallic primer tube sealed through a wall thereof. Deformation of the tube causes deflagration of the primer material therein up through the tube to ignite a combustible material (e.g. shredded zirconium) within the envelope.

Other variations of percussively ignited lamps are shown in U.S. Pat. Nos. 3,606,607 (J. W. Shaffer) and 3,706,521 (B. Kopelman et al), said patents also assigned to the assignee of this invention. The process for making these lamps involves sealing a metallic component having the desired primer mixture therein about a base or bottom portion of the glass envelope.

Yet another example of a percussively ignited photoflash lamp is described in German Offenlegungsschrift 2161365. Ignition of this lamp is accomplished only by rupturing the destroyable envelope using a primer-type ignition means located outside the lamp's envelope.

A disadvantage inherent in lamps utilizing a metallic primer within the wall of a glass envelope or about the bottom portion thereof involves the proper sealing of these components. A mismatch in the seal region results in stressed or cracked seals which can render these lamps inoperable. Proper seals are posible, provided suitable materials are used in continuous care is taken during manufacture. Another disadvantage of these lamps is that relatively few glass compositions can be sealed economically to metal or metal alloy primer tubes. One of the best matches known to date involves mating Sylvania "No. 4 Alloy" with G-1 soda lead (soft) glass. Ideally, however, it is preferred to use the harder glasses which as Vycor (high silica) or quartz for lamp envelopes but these compositions do not render themselves to high speed manufacturing techniques involving glass-to-metal sealing.

Understandably, a disadvantage inherent in German Offenlegungsschrift No. 2161365 is the requirement for rupturing the lamp's envelope. Because most percussive lamps contain a pressurized combustion-supporting atmosphere therein, rupturing the envelope to provide ignition will present an extremely hazardous condition to the operator of the camera which utilizes the lamp.

It is believed, therefore, that a percussively ignited photoflash lamp which eliminates the need for glass-to-metal or similar type seals within the lamp's envelope would constitute a significant advancement in the art. It is also believed that a new method for making such a lamp would constitute an advancement in the art.

OBJECT AND SUMMARY OF THE INVENTION

It is, therefore, a primary object of the present invention to enhance the percussive photoflash lamp art by providing a percussively ignited lamp and method for making same wherein the above-cited disadvantages of prior art lamps and methods are substantially eliminated.

In accordance with one aspect of the invention, there is provided a percussively ignited photoflash lamp which comprises a hermetically-sealed envelope, a combustion-supporting atmosphere and a quantity of combustible material within the envelope, and an ignition means which is disposed within the envelope and adapted for igniting the combustible material in response to application of a percussive force to an external surface of the envelope.

According to another aspect of the invention, a method is provided for making a percussively ignited photoflash lamp. The method includes providing an envelope having an open end, locating a quantity of combustible material within the envelope, disposing an ignition means within the envelope, providing a combustion-supporting atmosphere within the envelope, and thereafter hermetically sealing the open end.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
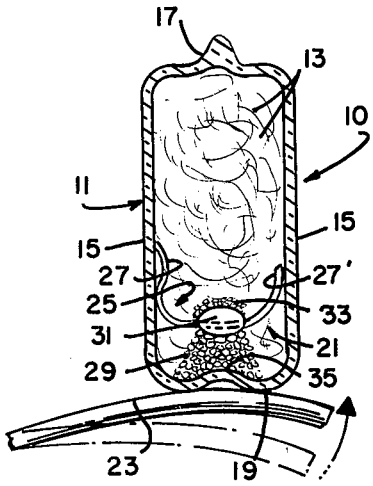
FIG. 1 is a side elevational view, in section, of a percussively ignited photoflash lamp in accordance with a preferred embodiment of the invention.

With particular reference to FIG. 1, a percussively ignited photoflash lamp 10 is shown as comprising a hermetically sealed envelope 11 of light-transmitting material. This material is preferably vitreous and more preferably quartz glass. Such material is well recognized as possessing a high degree of resistance to thermal shock, thus making envelopes comprising said material less susceptable to rupture during lamp ignition. By way of example, the quartz glass used in envelope 11 has a hardness rating of about 4.9 Mohs and a coefficient of thermal expansion of approximately $0.55\times10-6$ cm./cm./° C.

With regard to the present invention, the term envelope is meant to define a component of the above materials wherein no glass-to-metal or similar seals exist within the walls of said component. These walls of course include any top, bottom, or similar end portion.

A quantity of filamentary combustible material 13 (e.g. shredded zirconium or hafnium) is located within envelope 11 along with a suitable combustion-supporting atmosphere. This atmosphere is preferably oxygen and is established within envelope 11 at a pressure within the range of about 6 to 20 atmospheres. Furthermore, the overall internal volume of envelope 11 is preferably within the range of about 0.04 to 0.68 cubic inches. The corresponding thickness of the side walls 15, top 17, and bottom 19 of envelope 11 are preferably from about 0.015 to 0.041 inches thick.

Also within envelope 11 is a percussively-actuated ignition means 21 which is disposed therein and is adapted for igniting material 13 in response to application of a percussive force to one of the external surfaces of the envelope. In the embodiment of FIG. 1, this force is applied to bottom 19 while means 21 frictionally engages at least one of the internal surfaces of walls 15. A percussive force is represented in the drawings as being applied by a striker arm 23 which moves as indicated to provide this function. It is to be understood, however, that arm 23 represents only one of several means possible for percussively-igniting lamp 10. As an example, the lamp itself could be held in some manner and struck against a suitable, stationary surface. With regard to the invention, a spring force from about 12.0 to about 20.0 ounces was sufficient to ignite lamp 10.

Ignition means 21 comprises an anvil member 25 which includes first and second opposing ends 27 and 27' which frictionally engage the illustrated internal surfaces of envelope 11. Located on anvil 25 is a quantity of combustible primer material 29 which is shown in FIG. 1 as also being in contact with (or engaging) the internal surface of bottom 19. Anvil 25 is preferably a springloaded wire having the substantially U-shaped configuration shown with one leg somewhat longer than the other. As an example, a 0.014 inch diameter piano wire having a length of about 1.5 inches was successfully used.

As stated, ignition means 21 is preferably frictionally disposed within envelope 11. Accordingly, the application of the above percussive force results in primer material 29 being ignited to in turn ignite combustible material 13 and cause a highly intense flash of light to be emitted. It is understood that ignition means 21 needn't be frictionally positioned within envelope 11 but instead may be fixedly retained therein such as by using an inorganic cement or similar material.

At present, it is not exactly known how primer material 29 becomes ignited by the applied percussive force. It is believed that striker arm 23 produces a pressure wave which travels through the glass bottom 19 and is reflected back toward bottom 19 by the wire anvil 25. This pressure wave is sufficient to activate the primer material 29, with initial activation occurring at the interface between the material and the internal surface of bottom 19. Another theory involving the cause of ignition of primer 29 when using the ignition means of FIG. 1 is that the frictionally disposed wire anvil 25 becomes slightly displaced relative to the upward movement of bottom 19. In other words, primer material 29 is subjected to a compressive force applied by the anvil against the internal surface of bottom 19, said compression in turn causing the primer to ignite.

With further regard to the invention, it is preferred that in order to substantially assure that breakage of envelope 11 is prevented during lamp ignition, the mass of internal anvil 25 should be at least equal to or greater than the mass of the striker arm 23.

The preferred primer material 29 for use within lamp 10 comprises from about 50 to 83 percent sodium chlorate, from about 15 to 45 percent phosphorous (red), and from about 1 to 5 percent magnesium oxide. All of the above percentages are by weight of the material.

Positioning of primer 29 on wire anvil 25 is facilitated by providing the anvil with an enlarged body portion 31 and locating the primer thereon. Body portion 31 preferably comprises a bead of solder material (e.g. a 60/40 tin/lead alloy). After being secured to wire 25 and solidified, the solder bead is sandblasted to provide an irregular or roughened surface thereon. It is to this surface that the described primer 29 is adhered.

Lamp 10 may further comprise a second primer material 33 dissimilar to the first primer 29 and located on wire anvil 25, preferably on enlarged body protion 31 immediately adjacent first primer 29. Second primer 33 is thus adapted for being activated by the igniting of first primer 29 to in turn ignite combustible material 13. Understandably, this feature enhances ignition of material 13. It is understood, however, that use of only the first primer is sufficient to assure successful activation of lamp 10. Second primer material 33 is preferably comprised of from about 10 to 80 percent zirconium, from about 10 to 80 percent magnesium, and from about 10 to 80 percent potassium chlorate. All of these percentages are by weight. Second primer 33 differs from first primer 29 particularly with regard to the addition of zirconium, which is in powdered form and thus serves to enhance the ignition of the combustible material 13. Primer ignition may also be enhanced by providing the internal surface of bottom 19 with a protruding tip portion 35. Tip 35 either promotes the movement of the aforedescribed pressure wave, or the cited compression of material 29, whichever of the above theories applies.

FIGS. 2–7 represent the steps in the preferred method for making a percussive photoflash lamp such as described in FIG. 1.

Figure 2:
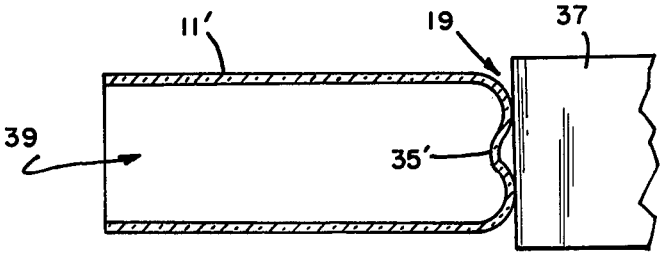
FIGS. 2–7 represent the steps of a preferred method of the invention for making a percussively ignited lamp.
Figure 3:
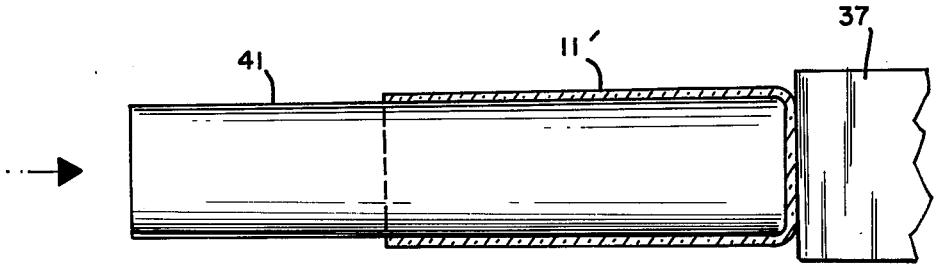
Figure 4:
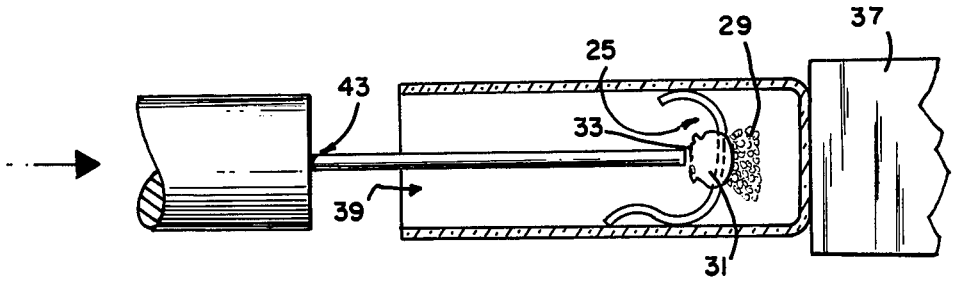

A quartz tube 11' having a 0.118 inch internal diameter and a 0.158 inch external diameter was cut approximately 2.25 inches long. As an optional strengthening step, tube 11' was immersed in an acid solution containing about 8 percent hydrofluoric acid and the remainder water. The tube was then rinsed in deionized water and forced-air dried. The tube was then chucked in the headstock of a horizontal glass lathe for purposes of forming (and sealing) the bottom of the tube. The tube end 19' nearest the tailstock was heated to a working temperature of about 1700° C. with a small, concentrated oxygen-hydrogen burner. A portion of the heated end was gathered and extracted with a disposable piece of glass cane to insure that the lamp bottom was of approximately the same thickness as the walls. The tube end was heated further to assure closure. Simultaneously, a flattened graphite rod 37 of approximately 0.750" diameter held in the lathe tail stock ws brought to bear externally against the tube bottom 19' while air was introduced through an open end 39 of the tube. This operation yielded an essentially flat, yet slightly concave vessel bottom (see FIG. 2. The concaveness was totally eliminated with a follow-up operation consisting of pushing a No. 309 stainless steel or tungsten rod 41 into the open end 39 such that the hot lamp bottom was momentarily sandwiched and formed between the rod end and external graphite rod 37 (see FIG. 3). It should be added, however, that this latter step is optional and for the reasons defined, it may be preferred to include a concave (or internally protruding tip) portion 35' (FIG. 2).

Control of the thickness of the lamp bottom is believed important in the production of the invention. In some examples, lamp bottoms in excess of 0.040 inches proved too thick to safely transmit external spring energies through the glass to the internal primer 29. On the other hand, lamp bottoms less than 0.015 inches were avoided to prevent glass bottom breakage from the impact of the external firing spring. The next step in the construction of the leadless lamp consisted of fabricating the metal anvil wire 25. The shape and dimensions chosen were primarily picked for convenience of hand fabrication and handling, although care was taken of course to miniaturize the metal structure.

As stated, piano wire of 0.014 inches diameter was picked for the fabrication of the wire 25. The overall width of the shaped piece was about 0.150 inches. This dimension, approximately 0.032 inches greater than the internal diameter of the lamp tube (0.118 inches) was chosen to assure that the anvil would be securely fastened when inserted into the lamp tube 11'.

The material chosen for the anvil's enlarged body portion 31 consisted of a small, approximately spherical bead of the described 60/40 tin/lead allow. The material was chosen primarily for convenience. Glass fritted beads or metal press forged beads would serve equally well. The solder bead 31 was attached to the piano wire 25 by pre-cutting a 0.375 inch piece of the 22 SWG solder and fusing it to the wire at the illustrated location with the use of a propane torch. A metal jig was used to properly locate the bead on wire 25.

The surface of the solder bead was then sandblasted subsequent to the fusion operation to obtain the roughened surface necessary to enhance adhesion of the primer at a later time. After the sandblasting operation, the bead and wire were washed in alcohol and dried to remove traces of foreign matter.

The next operation in the fabrication of the lamp consisted of applying a primer 29 onto the sand blasted anvil face previously described. Of the chosen primer material 29 previously described, only the sodium chlorate was ground and only those chlorate particles passing thrugh a No. 120 sieve were used.

Unlike the primer used in many previous percussive lamps (an absorbed oxidizer mix) all of the described fulminating ingredients were admixed prior to application. Blending was achieved by slurrying small quantities (e.g. 10–30 mg) of the three component system in acetone followed by evaporation of the acetone. An aqueous blending vehicle was avoided to prevent the formation of large sodium chlorate crystallites.

The primer mix, free of agglomerates, was reblended in a dilute nitrocellulose, butyl acetate binding agent. The viscosity of this prepared slurry was of a "mud-like" consistency. It is estimated that the quantity of nitrocellulose binder in the primer was in the order of a few tenths of a percent.

The sand blasted body 31 was coated with a small quantity (e.g. 0.5–2.0 mg) of the primer slurry. Volatilization of the butyl acetate was achieved by force air drying the coated anvil at approximately 100° C. for about 10 to 15 seconds.

In addition to the application of the primer material 29 on body 31, a small dab (approximately 0.1 to 0.5 mg) of the aforedescribed primer 33 was coated and dried on a region adjacent primer 29. This primer acted as a combustion-supporting agent. Because of the close communication between the phosphorus based primer 29 and metal ziroconium foil it should be added that addition of primer 33 is an optional step and is done for the purpose explained. The wire with adhered solder 31 and predisposed quantity of primer 29 and 33 were inserted into the lamp tube 11' by applying sufficient pressure to a metal ramrod 43 (see FIG. 4) against the top of body 31 so as to cause compression of the retaining wire into the lamp tube. Pressure was exerted on ramrod 43 until primer 29 firmly contacted the lamp bottom.

Figure 5:
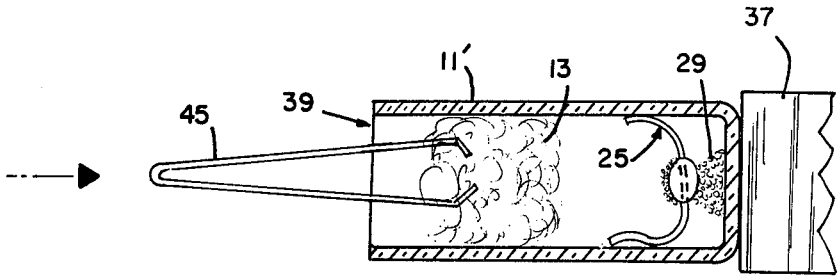

Seven milligrams of zirconium shreds 13, each approximately one mill in cross-section, by four inches in length, were crumpled and inserted into the open end 39 with the use of tweezers 45 (see FIG. 5). Care was taken to disperse the fill throughout the approximately 0.1 cc tube volume.

Figure 6:
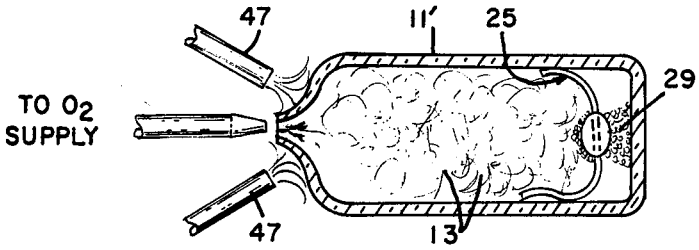
Figure 7:
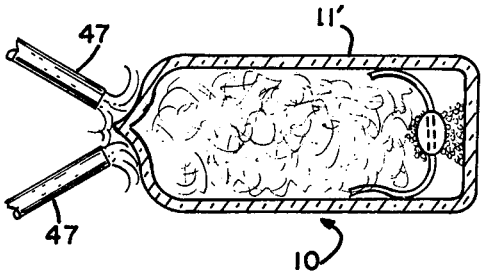

Necking of the quartz tube 11' was accomplished by heating the open end to approximately 1700° C. using at least one concentrated oxygen-hydrogen burner 47 (two are shown in FIG. 6). The tube was evacuated to a pressure of approximately 2–15 torr prior to backfilling with essentially pure oxygen (see FIG. 6) to a stoichiometric fill pressure of approximately 290 psi. Lamp tipping was thereafter performed with the use of the oxygen-hydrogen tipping torch 47 (see FIG. 7). Accordingly, tube 11' was hermetically sealed. As an optional step, the newly formed photoflash lamp 10 (FIG. 7) was dip-coated in cellulose acetate (not shown). Cloating thicknesses averaged from about 3 to 5 mils. The function of the acetate coating is well established in photoflash lamp production, that being to serve as an added strengthening agent about the envelope to reduce the chances for violent glass rupture during lamp flashing. This step is considered optional with regard to the instant invention primarily due to the relatively high strength of the quartz material used.

Figure 8:
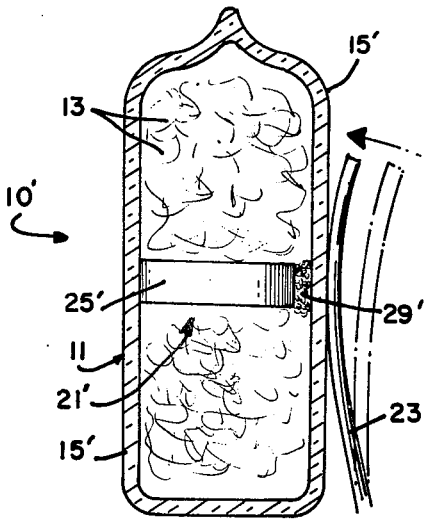
FIG. 8 is a side elevational view, in section, of a photoflash lamp in accordance with another embodiment of the invention.

In FIG. 8, an alternate embodiment of a percussively-ignited photoflash lamp 10' is shown. Lamp 10' includes many of the same components (envelope 11, combustible material 13, and a combustion-supporting atmosphere) as lamp 10 in FIG. 1. The difference between these lamps, however, may be found in the respective ignition means used. In lamp 10', the ignition means 21' comprises a resilient anvil member 25' which frictionally engages the internal surfaces of the envelope's side walls 15' and biases a primer material 29' (similar to primer 29 in lamp 10) against one of these surfaces. Accordingly, a striker arm is utilized to apply a percussive force against the external surface of envelope 11' opposite the primer's location to achieve lamp ignition. Anvil 25' is preferably a steel cylindrical band member.

Thus there has been shown and described a percussively-ignited photoflash lamp wherein the lamp's envelope is free of glas-to-metal seals and the disadvantages associated therewith. There has also been shown and described a method for making this lamp.

While there have been shown and described what are at present considered the preferred embodiments of the invention, it will be obvious to those skilled in the art that various changes and modifications may be made therein without departing from the scope of the invention as defined by the appended claims.

What we claim is:

1. A percussively-ignited photoflash lamp comprising:

an hermetically-sealed, light-transmitting envelope;

a combustion-supporting atmosphere within said envelope;

a quantity of filamentary combustible material within said envelope; and percussively-actuated ignition means disposed within said envelope for igniting said filamentary combustible material in response to the application of a percussive force to the external surface of said envelope; said ignition means including a resilient member located between opposed walls of said envelope for engagement therewith, and a quantity of primer material located on said resilient member in contact with an internal surface of the wall of said envelope to receive said precussive force.

2. The photoflash lamp according to claim 1 wherein said envelope is comprised of vitreous material.

3. The photoflash lamp according to claim 2 wherein said vitreous material is quartz glass.

4. The photoflash lamp according to claim 1 wherein said resilient member comprises an anvil member frictionally engaging at least one of the internal surfaces of said envelope.

5. The photoflash lamp according to claim 4 wherein said anvil member comprises a spring-loaded wire having first and second end portions, said end portions frictionally engaging opposing internal surfaces of said envelope.

6. The photoflash lamp according to claim 4 wherein said anvil member comprises a resilient band member which frictionally engages the internal surfaces of said envelope and biases said primer material against one of said surfaces.

7. The photoflash lamp according to claim 4 wherein said primer material is comprises of sodium chlorate ranging from about 50 to about 83 percent by weight of said material, phosphorous ranging from about 15 to about 45 percent by weight of said material, and magnesium oxide ranging from about 1 to 5 percent by weight of said material.

8. The photoflash lamp acccording to claim 4 wherein said anvil member includes an enlarged body portion having an irregular surface thereon, said primer material located on said irregular surface.

9. The photoflash lamp according to claim 8 wherein said enlarged body portion is comprised of solder material.

10. The photoflash lamp according to claim 4 further including a second quantity of primer material dissimilar to the first primer material and positioned on said anvil member at a location immediately adjacent said first primer material.

11. The photoflash lamp according to claim 10 wherein said second primer material is comprised of zirconium ranging from about 10 to about 80 percent by weight of said material, magnesium ranging from about 10 to about 80 percent by weight of said material, and potassium chlorate ranging from about 10 to about 80 percent by weight of said material.

12. The photoflash lamp according to claim 1 wherein the internal surface of said envelope relative to said primer material includes a protruding tip portion.

* * * * *